United States Patent [19]

Cariou et al.

[11] Patent Number: 4,900,431

[45] Date of Patent: Feb. 13, 1990

[54] PROCESS FOR UPGRADING ANDALUSITE

[75] Inventors: Florence Cariou; Jean-Jacques Predali; Philippe Raveneau, all of Elancourt, France

[73] Assignee: Denain-Anzin Mineraux Refractaire Ceramique S.A., Longueville, France

[21] Appl. No.: 287,164

[22] Filed: Dec. 21, 1988

[30] Foreign Application Priority Data

Dec. 24, 1987 [FR] France ..... 87 18135

[51] Int. Cl.[4] ..... B03D 1/02

[52] U.S. Cl. ..... 209/166; 209/3

[58] Field of Search ..... 209/164, 166, 167, 17, 209/3; 241/20

[56] References Cited

U.S. PATENT DOCUMENTS

| | | | |
|---|---|---|---|
| 2,238,439 | 4/1941 | Bishop | 209/166 |
| 2,289,741 | 7/1942 | Tartaron | 209/166 |
| 2,305,502 | 12/1942 | Tartaron | 209/166 |
| 2,326,807 | 8/1943 | Tartaron | 209/166 |
| 3,117,924 | 1/1964 | Baarson et al. | 209/166 |
| 3,214,018 | 10/1965 | Neal | 209/166 |
| 4,213,851 | 7/1980 | White et al. | 209/166 |

OTHER PUBLICATIONS

Haw, V., "Kyanite in Canada", The Canadian Mining & Metallurgical Bulletin, vol. XLVII, Nos. 501–512, pp. 27–34, Jan. 1954.

Chemical Abstracts, vol. 66, No. 5, Jan. 30, 1967, p. 1990, No. 20617x.

Browning, J., "Flotation of Southeastern Kyanite Ore", Society of Mining Engineers, AIME, Transactions, vol. 244, Sep. 1969, pp. 283–287.

Joy, A., "Flotation of Silicates", Trans. IMM Section C, vol. 75, 1966, pp. C75–C80.

Chemical Abstracts, vol. 68, 1968, #14972, "Surface Properties and Floatability of Kyanite and Andalusite," by H. S. Choi and J. H. Oh.

Chem. Abstracts, vol. 69, 1968 #78830, "Some factors affecting the limiting conditions in cationic flotation of silicates" by Watson et al.

*Primary Examiner*—David L. Lacey

*Assistant Examiner*—Thomas M. Lithgow

*Attorney, Agent, or Firm*—Fleit, Jacobson, Cohn, Price, Holman & Stern

[57] ABSTRACT

The invention relates to a process for upgrading andalusite present in an ore containing it. The process involves separation from other silicates by froth flotation to obtain a concentrate whose content of andalusite is higher than 90%. It is characterized by the fact that the process comprises at least the following steps:

(a) grinding as may be required and placing in pulp of the ore containing the andalusite (b) pre-conditioning the ore containing the andalusite by keeping the pH of the aqueous phase of the pulp at a value of below 3.50, the solids ratio in the pulp being higher than 30% (by weight)

(c) conditioning the preconditioned ore pulp for at least 10 minutes after addition of an alkyl sulfonate;

(d) dilution as may be required of the pulp to bring it to a solids ratio comprised between 15 and 30% (by weight);

(e) froth flotation by bubbling calibrated air bubbles therethrough in manner known in itself, the froth flotation proper lasting at the most 10 minutes. The invention is useful in the production of refractory raw materials.

17 Claims, 2 Drawing Sheets

PROCESS FOR UPGRADING ANDALUSITE

The present invention, which was made in the laboratories and mobile pilot plants of the MINEMET RECHERCHE Company, relates to a process for upgrading an industrial mineral, andalusite, which is a particular form of aluminum silicate.

This mineral is often associated with other silicates and sometimes even with certain ones having the same formula.

Separation of silicates from one another is a particularly delicate operation since it often brings into play similar flotation mechanisms. The flotation of such minerals often necessitates long studies and a considerable knowhow since frequently compounds of the same formula float very differently. As examples may be mentioned quartz and chalcedony. This difficulty is also to be found with other non-silicate minerals : there may be mentioned pyrites and marcassite which, although having an identical formula, by reason of their different crystalline lattice, have, under identical conditions, their selectivity with respect to other metallic sulphides reversed during flotations.

The flotation specialist know henceforth the reagents enabling flotation of silicate compounds to be performed. These reagents are generally alkylsulfonates, primary, secondary, tertiary amines or salts of quaternary amines. It is also possible to use certain carboxylic acids, particularly those known under the name fatty acids.

However in the case of andalusite, taking into account the low profitability of this industrial mineral, many techniques are inapplicable by reason of their cost. In addition, this aluminium silicate is generally difficult to separate from its gangue, itself silicated. Among the constituent minerals of this gangue, may be mentioned particularly quartz, feldspar- palgioclase, muscovite and biotite. In addition, to obtain a commercial grade, the iron content must be extremely low.

A mineral close to andalusite, kyanite (sometimes called disthene), but which possesses distinct properties from andalusite, has already been the subject of study with a view to enrichment by flotation. However, the authors of this last study came to different conclusions from those of the research according to the present application and on the other hand only concluded in the possibility of enrichment under particularly burdensome conditions of little selective nature with respect to silicates present when they are applied to the flotation of andalusite.

As a reference study on the kyanites, the article of V.A. HAW "Kyanite in Canada" in The Canadian Mining and Metallurgical, Jan. 1954, pages 27–34, may be mentioned, in which the author indicates that the best results are obtained in the area of pH 4.0–4.5 at a temperature of 30° C. Practically similar conditions are to be found in the article of J. S. BROWNING which appeared in the transactions of the AIME in September 1969 (vol. 244, pages 283–287) under the title "Flotation of Southeastern Kyanite Ore": pH of 3.7 and on rough flotation (roughing) and 3.9 on repeat flotation (cleaning) and a temperature of 27° C. during conditioning.

For this reason, one of the objects of the present invention is to provide an upgrading process for andalusite by separation of the latter from its gangue and particularly from other natural silicates such as quartz, feldspar plagioclase, muscovite and biotite.

It is another object of the present invention to provide a process of the preceding type of which the operational costs are as low as possible.

Another object of the present invention is to provide a process which avoids having to operate at a temperature above ambient temperature and which therefore permits use of the process under variable climatic conditions and especially that its economy is not affected by the summer-winter rhythm.

These objects, as well as others which will appear below, are achieved by means of a process for upgrading andalusites present in a ore containing it, by separation from other silicates by flotation to obtain a concentrate whose content of andalusite is higher than 90%, characterized by the fact that it comprises at least the following steps :

(a) grinding, as the case may require, and pulping of said ore containing the andalusite (b) conditioning of said ore containing the andalusite by maintaining the andalusite by maintaining the pH of the aqueous phase of the pump at a value of below 3.50, the ratio (by weight) of solids in the pulp being higher than 30% (to one significant figure) ;

(c) conditioning for at least ten minutes after addition of an alkyl sulphonate ;

(d) dilution, as the case may require, of said pulp to bring it to a solids ratio (by weight) comprised between 10% and 30% ;

(e) froth flotation by bubbling of calibrated air bubbles in a manner known in itself, the flotation proper lasting at the most ten minutes.

When, for various reasons such as a basic gangue or the addition of basic reagents, the pH rises above the indicated maximum, it is preferable to regulate the pH in steps (c), (d) and (e) to a value below 4.

The two operations of grinding and pulping of step (a) may be performed simultaneously in the case of wet grinding.

It is preferable for the grinding of step (a) to be conducted so that said compound has a $d_{80}$ at the most equal to 0.5 millimeter (figure rounded according to mathematical usage).

It is recalled that $d_x$, where x is comprised between 1 and 100, is the smallest mesh allowing X% of the weight of the product to pass. Thus, the $d_{80}$ of the smallest mesh allowing 80% of the product to pass.

To obtain a good yield from the flotation, it is desirable for said $d_{80}$ to be at the most equal to 400 micrometers (to one significant figure) and higher than the lower limit of the flotation, which is of the order of 10 micrometers (to one significant figure).

To obtain good selectivity with respect to other silicates and the gangue generally, the pH plays a very important part; it is advantageously kept to a value below 3 during step (b) as well as (c), (d) and (e).

In the field of selectivity, another parameter plays a non- negligable part : the ratio of solid (by weight), which, during steps (b) and (c), is preferably brought to and kept at a value of at least equal to 50%.

In general the first flotation performed is insufficient to bring the content of andalusite to a value substantially above 90%. In addition, this content of 90% is a relatively low limit which is insufficient for certain commercial grades and it is preferable for the content of andalusite to be higher than 95%, even 98%. This can be palliated by carrying out, following step (e), the following step :

(f) repeat flotation (cleaning) of the concentrate obtained in step (e).

This cleaning step is "per se" relatively conventional in flotation enrichment processes. In this particular case it necessitates the addition of further amounts of flotation reagents, here alkylsulphonic acids and alkali salts or ammonium salts. This cleaning of the concentrate may be performed in several sub-steps and in several flotation cells arranged in cascade.

In addition, extremely surprisingly, it has been shown, within the scope of the present study that the cleaning was only effective if the flotation step itself (e), called by technicians in the art "rough flotation", was conducted sufficiently rapidly, often to the detriment of the yield by weight.

A good guide for the technician in the art to obtain good cleanability of the crude concentrate is to stop this rough flotation when only 80 to 95% of the andalusite has risen in the form of froth.

In general, a period of about ten minutes ( to one significant figure), as indicated previously enables good results to be obtained.

The amounts of alkylsulphonate used in step (c), and, as the case may require, in step (f), are comprised between 300 to 1500 grams per ton of treated ore.

The alkylsulphonates used may be linear or branched chain and have preferably 8 to 16 carbon atoms. They include at the most two ramifications (namely three branches).

It is possible to use particularly those sold under the trade names of BAYMIN CO 300 and CO 301 of BAYER, SYNACTO 247 of PARAMINS, the Aeropromoters of the series 800 of CYANAMID, the reagent 7723 of CERLAND and R 231 of FLOAT ORE Ltd.

Advantageously, the pH of the pump, which may have changed during the alkylsulfonate addition, is brought back to a value at the most equal to 3 by the addition of a strong mineral acid particularly by means of an acid selected from the group of strong hydrohalogen acids (HCl, HBr, HI), sulfuric, nitric and phosphoric acids.

One of the advantages of the present invention is that, contrary to known processes for neighboring minerals, there is no need to regulate the temperature. The prefered temperature is therefore ambient temperature whatever the climatic conditions. It is perfectly possible to operate the process in the range of temperature 10°-30° C.

One of the important restrictions for commercialisation of andalusites is their content of iron which must be as low as possible and preferably not excede 1.5% expressed as $Fe_2O_3$.

In the case where there is iron in the form of ferriferous sulfur compounds, between steps (a) and (b) a flotation is carried out or a possible magnetic separation in the case of pyrrhotite, of the latter by techniques known in themselves. It is well understood that, in order that this flotation may be effective, the grinding step (a) should be conducted so as to liberate at least 60% of said ferriferous sulfur compounds, preferably 90-95%. A good compromise is often 90%.

In the course of the study which led to the present invention, it was shown surprisingly that to perform a good elimination of ferriferous sulfur compounds, such as pyrite, marcassite, chalcopyrite, pyrrhotine, it is preferable for the duration of the flotation proper of said ferriferous sulfur compounds to be equal to a value greater than the usual value of the flotation of sulfides such that the technician in the art can determine it. By way of indication, the value selected for said duration is between 1.5 and 3 times said usual duration for this type of compound, all things being otherwise equal.

It has been noted surprisingly that by acting thus in using conventional collectors of sulfides, preferably xanthates, not only the ferriferous sulfur compounds are floated but also the ferriferous phyllitous compounds.

To obtain good selectivity, the presence of fine particles is troublesome and the latter must be eliminated by carrying out a desliming before step (b).

The desliming is advantageously performed by elimination of at least 75%, preferably of at least 90%, of the solid particles below 50 micrometers (to one significant figure).

However, according to the classification technique used, preferably a classification technique by equivalence, it is preferable for the desliming to be conducted in an as efficient manner as possible, to the limit of the possibility of its means, which implies for these two techniques an elimination of at least 95% of the solid particles below 50 micrometers.

One of the surprising and advantageous aspects of the process according to the present invention is that it has been demonstratable that the adsorption the sulfonate on the andalusite is reversible and it is therefore possible to obtain andalusite without sulfonate by rinsing in a basic medium (higher than or equal to 9) of the flotation concentrate.

By way of indication, such a rinsing may be carried out by the following sequence of operations :

1. Conditioning (repulping) with caustic soda (NaOH) (1 kg/t of concentrate) for 5 min (ratio of solids higher than 10%).
2. Drainage on a screen ;
3. Conditioning (repulping) with water for 5 mins ;
4. Drainage on a screen (operations 3 and 4 may be reapeated once or several times according to the degree of removal of the sulfonate desired).

Standard flotation tests on the repulped cake at natural pH (about 9) and to 20% of pulp ratio aproximately does not entrain andalusite in the overflow thus demonstrating the absence of significant residual adsorption of the alkyl sulfonates on the andalusite. It is to be noted that this flotation technique permits the sulfonate content to be lowered in the mother liquors and that such a technique can be used to eliminate a part of the alkyl sulfonates.

The filtrate emerging from step 2 may be recycled to step (c) of the process, especially if the solids ratio in operation 1 is higher than ½, preferably than ¾ (rounded figures).

In addition, to avoid the risks of sanding up of the industrial flotation plants, it is desirable to add foaming agents, for example those of the polyglycol type such as those sold under the trade mark Aerofroth 65 of American Cyanamide (cf. example 5).

The following non-limiting examples enable the technician in the art to appreciate better the different parameters of the process according to the invention.

EXAMPLE 1

Description of the Process of Enrichment at the Pilot Stage

Figure 1:
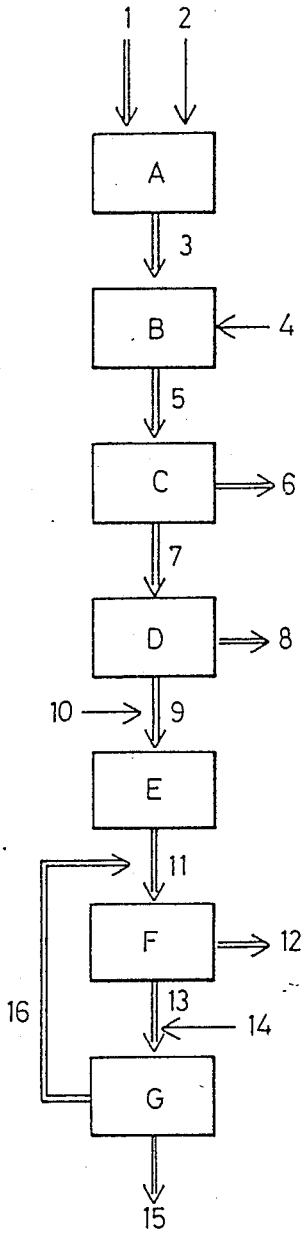
FIG. 1 is a flow diagram of the process according to the invention.

Reference will be made to FIG. 1 constituting a flow chart of the process tested.

Into a ball mill (A), is introduced the ore to be treated (1) and water in the amount necessary for a concentration by weight of solids of 30%. The charge of balls, graded from 10 to 40 millimeters, is calculated so as to deliver at the outlet of the mill a pulp (3) whose granulometery is for 80% by weight less than 240 micrometers. The pulp (3) is then introduced into a double bladed reactor (B), brought to a concentration of solids (by weight) of 20 to 25% by addition of water (4) and conditioned for three minutes in the presence of sulfuric acid in sufficient amounts to maintain a pH of value 5 and a dose of 100 grams per ton of ore of sulfide collector of the family of xanthates. The pump (5) is then led to flotation cells designed to collect the iron-bearing sulfides. This flotation step, of duration 10 minutes, is performed in several MINEMET ® H 300 cell banks with 2 or 3 turbines (C) operating in series. Each turbine delivers 3.3 $m^3/h$ of air. The number of turbines is advantageously brought to a value at least equal to 5. The introduction of 20 grams per ton of surface active agent (Methyl-isobutyl carbinol) at the beginning of flotation enables the recovery in the form of foams of the iron bearing sulfides as well as some phyllitous ferriferous minerals (6). In this example the floated product represents 2 to 3% of the weight of the supply. The material discarded from this step is pumped to a double pitch screw classifier (or a cyclone) (D) in which the cut between the finest particles (less than 40 micrometers) which constitute the diluted rejected material (8) and the particles of size greater than 40 micrometers (9) which constitute the supply of the andalusite flotation, is effected by equivalence(sizing according to equivalent particle diameter e.g. by cycloning). This operation also enables the thickening of the pulp (9) to a value of concentration by weight of solids of 70%.

The pump (9) which contains 91.5% by weight of ore is then introduced into two double bladed conditioners (E) operating in series.

During the first conditioning, which lasts 6 minutes, an addition of water (10) is made so as to obtain a concentration of solids (by weight) of 50% and an addition of sulfuric acid in sufficient amount to maintain a value of pH equal if possible to 2.8 and in all cases less than 3. The second step is intended to condition for 10 minutes the sulfonate introduced in the proportion of 570 grams per ton of feed ore. The pulp (11) emerging from the second conditioning is pumped to the flotation cells (F), which are constituted by a bank of two MINIMET ® cells of type H 450 followed by two banks of three MINIMET ® cells of type H 300. The material rejected from the cleaning (16) also supplies cells (F), which leads to a concentration of solids (by weight) close to 30%. This flotation has a duration of 9 minutes. All of the turbines deliver 40 $m^3$ of air per hour. In the course of the rough flotation the pH must be kept at a value below 3 and a dose of 570 grams per tone of sulfonate introduced. The uncollected products (12), which represent 26.5% of the starting weight, constitutes the reject (tailings) from the andalusite flotation. The andalusite is for its part collected in the form of a foam (13) which supplies the cleaning stage (G). This last step which lasts 9 minutes, is performed at a concentration by weight of 20%, which involves an addition of water (14). The pH is also kept at a value at the most equal to 3 by the addition of sulfuric acid and 200 grams per ton of feed ore of sulfonate is added at the head of the two banks of triple MINEMENT ® H 300 cells.

The product collected constitutes the final andalusite concentrate, whilst the solids which have not floated (16) return to the head of the rough flotation (F).

Under these operational conditions, and for a feed ore (1) titrating 45.4% of alumina and 1.15% of iron expressed as $Fe_2O_3$, a refined product is obtained which titrates 59.2% of alumina and less than 0.6% of $Fe_2O_3$ whilst recovering more than 88% of the contained andalusite (see table below).

| Product | Weight % | Contents % Andal. | Contents % $Al_2O_3$ | Contents % $Fe_2O_3$ | Recoveries % Andal | Recoveries % $Al_2O_3$ | Recoveries % $Fe_2O_3$ |
|---|---|---|---|---|---|---|---|
| Feed | 100 | 65.5 | 45.4 | 1.15 | 100 | 100 | 100 |
| Pyrites flotation rejects | 97.5 | 66.8 | 46.5 | 0.65 | 99.5 | 99.9 | 55.5 |
| Slimes | 6.0 28.4 22.7 1.80 | 2.6 | 3.0 | 9.4 | | | |
| Andalusite flotation | 91.5 | 69.4 | 48.1 | 0.58 | 96.9 | 96.9 | 46.1 |
| Andalusite concentrate | 65.0 | 89.2 | 59.2 | 0.59 | 88.5 | 84.8 | 33.3 |

This example also demonstrates the positive influence of elutriation on the iron content of the product since this operation permits the iron content of the product to be lowered 10%. This results from the use of the screw classifier or cyclone (D) which permits the removal by elutriation of ferriferous phyllitous ores.

EXAMPLE 2

Influence of the Concentration of Solids of the Pulp during the Conditioning Preceding the Andalusite Flotation The influence of the concentration of solids of the pulp during the conditioning which precedes the andalusite flotation on the result of this flotation is clearly demonstrated by comparision of two pilot tests carried out, one with a percentage by weight of solids of 25%, the other of 50%.

Figure 2:
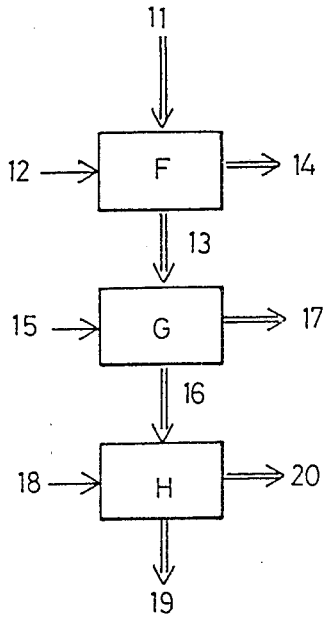
FIG. 2 is a flow diagram of an alternate embodiment to the last two steps (F and G) of FIG. 1.

The diagram of these two tests is fairly closely related to that of the preceding example. Reference will therefore be made to the flow chart of FIG. 1 for the steps comprised between A and E and to the flow chart of FIG. 2 for the following steps (F, G and H).

In this example, steps A, B, C and D are identical with those described in example 1. On the other hand there exist differences in the following operations. The addition of water (10) is evidently variable for the two tests described here : the concentrations of solids of the pulp during conditioning are 25% or 50%. Apart from this variation, step E is identical with that of the preceding example. Before the rough flotation step of the andalusite (F), water (12) is added so as to obtain a concentration of solids by weight of 25% in both cases. The evolution of step (F) is copied from that of example 1. The floated product (13) is again collected in the course of the cleaning step (G) after addition of water (15) enabling a concentration in the vicinity of 20% to be obtained. In the course of this step sulfuric acid is introduced to keep th pH at a value of 3. The flotation time and the equipment used are those of example 1 for this same step. The reject from this flotation (17) isnot recycled whilst the concentrate (16) undergoes a second cleaning (H) after a further addition of water (18) to maintain a solids concentration of 20%. Also sulfuric acid is used in sufficient amount to keep the pH at 3 and 250 grams of sulfonate per ton of feed ore. The circuit is identical to that of the first cleaning and enables collection of the final andalusite concentrate (19) and the elimination of reject from the second cleaning (20).

Tables 2.1 and 2.2 enable comparison of the balances obtained for the two concentrations from the conditioning (the calculations are made with respect to the product (11). It is observed that the type of conditioning has little influence on the andalusite rough flotation. On the other hand, the dilute conditioning is manifested by inefficiency in the cleanings (little grade improvement for a considerable drop in andalusite yield).

TABLE 2.1

Partial balance sheet of the pilot flotation of andalusite in the case of a dilute conditioning (25% by weight of solids).

| | Contents % | | Recoveries % | |
|---|---|---|---|---|
| | Andalusite | $Al_2O_3$ | Andalusite | $Al_2O_3$ |
| Andal. supply | 72.2 | 48.0 | 100.0 | 100.0 |
| Rough concentrate | 75.4 | 49.5 | 94.4 | 97.4 |
| Concentrate from cleaning 1 | 79.4 | 51.5 | 69.7 | 74.9 |
| Concentrate from cleaning 2 | 81.1 | 52.2 | 64.4 | 70.1 |

TABLE 2.2

Partial balance of the pilot flotation of the andalusite in the case of concentrate conditioning (50% by weight of solids).

| | Contents % | | Recoveries % | |
|---|---|---|---|---|
| | Andalusite | $Al_2O_3$ | Andalusite | $Al_2O_3$ |
| Andal. supply | 67.7 | 47.4 | 100.0 | 100.0 |
| Rough concentrate | 75.6 | 51.7 | 99.0 | 96.7 |
| Concentrate from cleaning 1 | 86.2 | 58.8 | 82.9 | 80.7 |
| Concentrate from cleaning 2 | 87.4 | 59.6 | 78.0 | 75.9 |

EXAMPLE 3

Influence of pH on the Result of the Flotation of Andalusite

Figure 3:
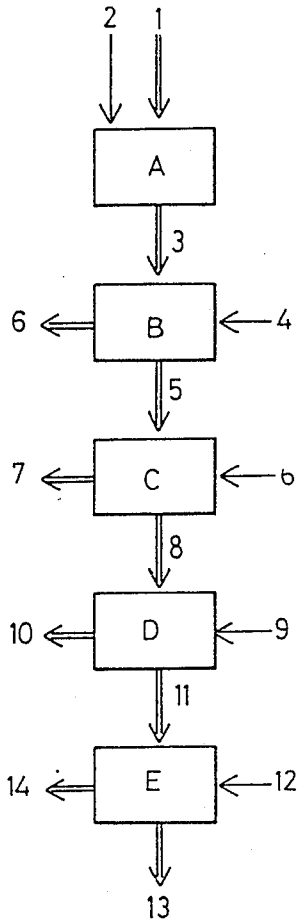
FIG. 3 is a flow diagram of the process according to the invention used to indicate the influence of pH on the flotation of andalusite.
Figure 4:
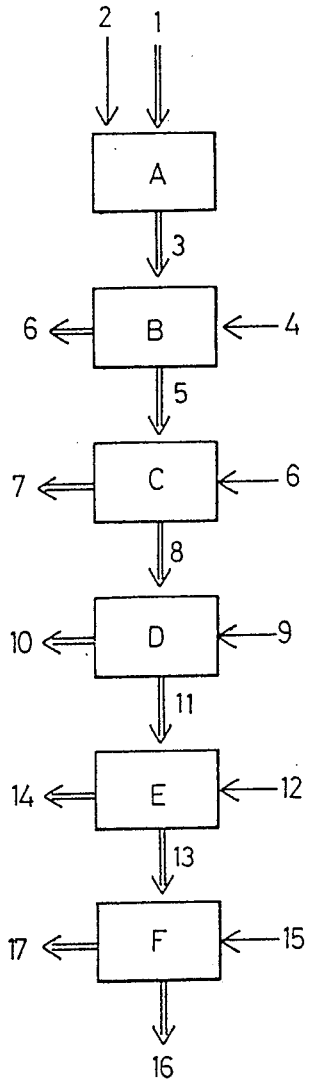
FIG. 4 is a flow diagram of the process according to the invention used to indicate the influence of roughing time on the firstr cleaner effeciency.

Reference will be made to FIG. 3 constituting the flow chart of the tested process.

In a porcelain ball mill A charged with 50 balls, 1kg of ore (1) is ground in the presence of water (2) to 70% weight of solid matter for 50 minutes. The pulp obtained (3) which the $d_{80}$ is 250 micrometers is sifted in the presence of water (4) on a screen (B) with 63 micrometers mesh. The refuse from the screening (5) is introduced into a flotation cell (C) of the brand MINEMET ® of 2.5 litres capacity in the presence of water (6), which brings the concentration to 40% weight of solids. The transited material from the screening (6) is considered as reject.

In cell (C) a conditioning of the pulp is carried out in the presence of sulfuric acid in sufficient amount to obtain a pH value of 5. Also 60 grams per ton of ore of sulfide collector(potassium amyl-xanthate : KAX) are introduced. After 2 minutes, air is introduced to carry out the flotation after having put in 8 grams per ton of a surface active agent (Methyl-isobutyl carbinol : MIBC). In the course of the flotation of the sulfides, 10 minutes in duration, 40 g/t of KAX and 15 g/t of MIBC are introduced in several doses. The concentrate obtained (7) is constituted by a sulfide pulp.

The reject from this flotation (8) is again screened (D) to 63 micrometers in the presence of water (9). The material passing the screen is rejected (10). The retained material from the screening (11) is introduced into a flotation cell (E) previously described at (C) as well as water (12), which brings the concentration to 60% (by weight) of solids. Then a conditioning of 10 minutes is performed in the presence of sulfuric acid in sufficient amount to obtain a pH value comprised between 2 and 5 according to the tests and of a collector of alkyl-sulfonate type in the proportion of 350 grams per ton. Then air is introduced for 7 minutes so as to ensure the collection of the andalusite and its overflow in the form of pulp (13). In the course of the flotation the pH is kept at the desired value by a system of measurement/regulation by servocoupled pump.

Also two other equal doses of sulfonate are introduced representing in total 700 grams per ton of ore. After the flotation, the cell is emptied from the rest of the pulp (14) containing the unfloated product.

The characteristics of the andalusite concentrate obtained after 7 minutes of flotation, are given in the following table for four different pH values. In this table the yield by weight is equal to the ratio of the weight of solid in the concentrate (3) to the initial weight of solid (1) expressed as percentage. The andalusite contents are those of the concentrate. The andalusite yields are the ratios of the weights of andalusite of the concentrate to that contained in the supply to the andalusite flotation (11).

| pH | % Yield by weight | Andalusite content % | Andalusite yield % |
|---|---|---|---|
| 2 | 66.6 | 90.1 | 97.7 |
| 3 | 68.6 | 85.2 | 99.5 |
| 4 | 85.3 | 69.4 | 99.7 |
| 5 | 82.8 | 69.8 | 98.9 |

The distinct diminution of selectivity is observed when the pH of the andalusite flotation is increased. In particular, for the pH value currently used for kyanite, selectivity is insufficient.

EXAMPLE 4

Influence of the Andalusite Roughing Time on the Efficiency of the First Cleaning The flow chart of the process is identical to that of example 3 as regards operations A, B, C and D. The principle of step E of rough flotation of the andalusite is also invariable. The only differences relating to the roughing are the collector dose equal here to 1200 grams per ton of ore in four additions, the flotation time (3.5 minutes for one test, 6 minutes for the other) and the dose of sulfuric acid introduced in sufficient amount during the whole flotation to keep a pH value of 3. It should also be noted that the ore (1) is different from that of example 3.

Following this flotation, the concentrate (13) is introduced into a flotation cell (F) as well as water (15), which brings the solids concentration to 30%. Then a conditioning is carried out in the presence of sulfuric acid intended to maintain a pH value equal to 3. Then air is introduced for 5 minutes to collect the andalusite by overflow (16). In the course of this flotation are added in two doses, 100 grams per ton of feed ore of collector of the alkyl sulfonic type as well as sulfuric acid in sufficient amount to keep the pH at the value of 3. After this operation, the product which has not been collected (17) is gathered at the bottom of the cell.

Results of the two tests bearing on the influence of rough flotation time on the efficiency of cleaning are given in the following table.

| | Rough Concentrate | | | Cleaning Concentrate | | |
|---|---|---|---|---|---|---|
| | % weight | % $Al_2O_3$ | Yield % $Al_2O_3$ | % weight | % $Al_2O_3$ | Yield % $Al_2O_3$ |
| Roughing 3.5 min | 62.9 | 58.2 | 90.3 | 60.9 | 59.3 | 90.2 |
| Roughing 6 min | 75.2 | 53.4 | 98.4 | 70.4 | 53.6 | 92.4 |

It is observed that with a short roughing the cleaning enables a grade improvement without loss of yield. On the contrary, when the roughing lasts 6 minutes, the cleaning hardly permits a gain in content in spite of a considerable loss of yield.

The following Example shows that in the course of industrial flotation, there is every advantage in adding at the beginning of the roughing flotation of the andalusite, 1/20 to 1/10 kg/t (rounded figures) of a foaming agent of the polyglycol type (for example Aerofroth 65 of American Cyanamid) to avoid sanding up phenomena.

In the same way the roughing flotation for concentrations of solid (by weight) in the pulp of less than 25 even than 20% also plays a role in combating sanding up phenomena.

EXAMPLE 5

Comparison of Results of Industrial Roughing Flotation With and Without Addition of Foaming Agent The roughing flotation was carried out as in example 1, with however a concentration of solid matter of about 20% and in cells of size distinctly greater than that of the pilot plant since they had a capacity of about $4m^3$, each cell being equiped with four turbines.

The first results showed a sanding up phenomenon that it was possible to palliate by means of systems known in themselves for automatic desanding. This sanding up phenomenon, associated with a problem of change of scale, was resolved by adding a foaming agent of the polyglycol type (Aerofroth 65 of American Cyanamid).

The results are summarized in the following table :

| | Concentrate from Industrial rough flotation | | |
|---|---|---|---|
| | Weight % | Content $Al_2O_3$ % | Recovery $Al_2O_3$ % |
| Coventional roughing | 59.4 | 58.3 | 71 |
| Roughing with 80 g/t of foaming agent | 73.2 | 58.4 | 85 |

We claim:

1. Process for upgrading andalusite present in an ore containing said andalusite and other silicates by separation of said andalusite from the other silicates by froth flotation to obtain a concentrate whose content of andalusite is higher than 90%, said process comprising at least the following steps:

(a) grinding and pulping said ore containing the andalusite;

(b) preconditioning said ore pulp containing the andalusite by maintaining the pH of the aqueous phase of the pulp at a value less than 3.50, the solids ratio in the pulp being higher than 30%;

(c) adding a sufficient amount of alkyl sulfonate to the preconditioned ore pulp to act as a collector for said andalusite and conditioning said preconditioned ore pulp for at least 10 minutes after addition of said alkyl sulfonate;

(d) dilution of said conditioned ore pulp to bring it to a solids ratio comprised between 15 and 30%;

(e) subjecting the diluted ore pulp to froth flotation by bubbling calibrated air bubbles therethrough, the froth flotation proper lasting at the most 10 minutes; and (f) recovering the andalusite concentrate from the froth of the said froth flotation.

2. Process according to claim 1, wherein the grinding of step (a) is conducted so that said ore has a $d_{80}$ at the most equal to 0.5 milimeter.

3. Process according to claim 1, wherein the pH is regulated during steps (c), (d), and (e) to the same numerical value as during step (b).

4. Process according to claim 1, wherein during step (b) the pH is kept at a value below 3.

5. Process according to claim 1, wherein the solids ratio during steps (b) and (c) is kept at a value at least equal to 50%.

6. Process according to claim 1, comprising following step (f) the following step:

(g) cleaning by the means of a second step of froth flotation the froth obtained in step (f) and recovering the cleaned andalusite in the froth of the said second step of froth flotation.

7. Process according to claim 1, wherein the amount of alkyl sulfonate used in step (c) is comprised between 300 to 1500 grams per tone of ore.

8. Process according to claim 1, wherein during step (C) the pH is kept at a value below 3.

9. Process according to claim 1, wherein to fix the pH a strong mineral acid is used selected from the group consisting of sulfuric, nitric and phosphoric acids.

10. Process according to claim 1, wherein the process is operated at an ambient temperature of 10–30 degrees C.

11. Process according to claim 1, wherein the ore contains ferriferous sulfer compounds and between steps (a) and (b) a flotation of the ferriferous sulfurized compounds is carried out and wherein the grinding step (a) is conducted so as to release at least 60% of said ferriferous sulfur compounds.

12. Process according to claim 1, wherein a desliming is carried out before step (b).

13. Process according to claim 12, wherein the desliming is carried out by elimination of at least 90% of the solid particles of less than 50 micrometers.

14. Process according to claim 13, wherein the desliming is performed by removal of at least 95% of the solid particles below 50 micrometers in size.

15. Process according to claim 12, wherein the desliming is carried out by means of screens or hydrocyclones.

16. Process according to claim 1, comprising in addition step (g) washing of the andalusite concentrate by means of a basic aqueous solution.

17. Process according to claim 1 wherein there is added in one of the steps (c) or (d) a foaming agent at a concentration comprised between 1/20 and 1/10 of kg/t of ore.

* * * * *